US005131383A

United States Patent [19]

Juarez

[11] Patent Number: 5,131,383

[45] Date of Patent: Jul. 21, 1992

[54] FOOT MASSAGE DEVICE

[76] Inventor: Gilbert T. Juarez, 1679 Cable St., San Diego, Calif. 92107

[21] Appl. No.: 620,657

[22] Filed: Dec. 3, 1990

[51] Int. Cl.[5] ..... A61H 1/02

[52] U.S. Cl. ..... 128/25 B; 128/57

[58] Field of Search ..... 128/57, 25 B, 60, 62 R

[56] References Cited

U.S. PATENT DOCUMENTS

| | | | |
|---|---|---|---|
| D. 253,373 | 11/1979 | Celeste | 128/57 |
| D. 256,503 | 8/1980 | Moustakas | 128/57 |
| 1,270,635 | 6/1918 | Ljungstrom | 128/24.3 |
| 1,481,038 | 5/1919 | Stephenson | 128/57 |
| 1,573,652 | 2/1926 | Snyder | 128/57 |
| 1,780,479 | 7/1926 | Griffith | 128/57 |
| 2,546,095 | 9/1948 | Gustlin | 128/24.3 |
| 2,787,261 | 11/1953 | McDonald | 128/24.3 |
| 3,037,500 | 7/1960 | Daugherty | 128/57 |
| 3,888,241 | 6/1975 | Fischer | 128/25 B |

*Primary Examiner*—Robert A. Hafer
*Assistant Examiner*—David J. Kenealy
*Attorney, Agent, or Firm*—Charles C. Logan, II

[57] ABSTRACT

The foot massage device is in the general form of an elongated tubular body member that has a plurality of pressure point members disposed on its outer surface. The tubular body is wide enough so that both feet of a person can be applied to the device at the same time. The tubular body has a left end portion, a central portion and a right end portion. The left and right end portions each have a convex outer surface along their longitudinal dimension and the central portion has a substantially constant outer diameter. In the preferred embodiment, the foot massage device has a permanently closed right end and the left end has a removable plug or cap so that either hot or cold fluid may be placed in the hollow tubular body to give the user beneficial results therefrom.

5 Claims, 1 Drawing Sheet

FOOT MASSAGE DEVICE

BACKGROUND OF THE INVENTION

The invention relates to a foot massager and more specifically to one that has a sufficient width that allows both of the users feet to be simultaneously placed upon the massage device.

Previous foot massage devices have taken many different forms. The Stevenson U.S. Pat. No. 1,481,038, discloses a solid conical member with cylindrical members at both its ends. The conical section has a plurality of protruberances for massaging the foot.

The Griffith U.S. Pat. No. 1,780,479, discloses an arch corrector having a roller that is mounted between two standards and the roller has a plurality of protruberances on its outer surface.

The Brogan U.S. Pat. No. 2,037,495 discloses a foot massaging device also in the form of a solid roller that is mounted between two arms. It has a plurality of longitudinally extending ribs having a configuration that slopes upwardly from its opposite ends to its center.

The Illch U.S. Pat. No. 2,080,208 also discloses a foot massaging device in the form of a solid longitudinally extending body member having a specifically curved portion covered by a resilient layer of material having resilient projections that form diamond-shaped suction cups for massaging a person's foot.

It is an object of the invention to provide a novel foot massage device that may be filled with either a hot or cold fluid as desired.

It is also an object of the invention to provide a novel foot massage device that allows the user to place both feet on the apparatus at the same time.

It is another object of the invention to provide a novel foot massage device that is designed to be utilized by a person in a seated position.

It is a further object of the invention to provide a novel foot massage device that is economical to manufacture and market.

SUMMARY OF THE INVENTION

Applicant's novel foot massage device has an elongated tubular body having a predetermined length that is sequentially formed by a left end portion, a central portion and a right end portion. The left end portion and the right end portion each have a convex outer surface along their longitudinal dimension. The central portion has a substantially constant outer diameter.

A predetermined number of protruberances are formed along the outer surface of the left end portion and the right end portion. These protruberances are oriented in a pattern of annular rows that are spaced inwardly from the respective ends of the tubular body at the respective axial distances L1, L2, L3 and L4. The protruberances of the respective rows are staggered so they are not longitudinally aligned. Each row preferrably has seven protruberances.

In one embodiment of the foot massage device, the left and right ends of the elongated tubular body are open. In a second embodiment, the right end is closed by a permanent end wall. The left end may take the form of a plug or cap that is threaded on that end. The interior of this version can be filled with a fluid that may be either heated or cooled as desired. The version that doesn't contain a fluid could also have its ends open or closed off.

The protruberances function as pressure point members. These members are substantially hemi-spherical in shape. The pressure point members may be either integrally formed with the tubular structure or separate members attached thereto. The entire apparatus may be formed of any desired materials, such as wood, aluminum, stainless steel, and the like. Depending upon the type of material used, the walls of the tubular body could have a uniform wall thickness or it could have wall thickness that vary throughout the tubular body.

In operation, the novel foot massage device is designed to be utilized by a person in a seated position. The user places both feet on the apparatus and rolls it in order to massage both feet.

DESCRIPTION OF THE PREFERRED EMBODIMENT

Figure 1:
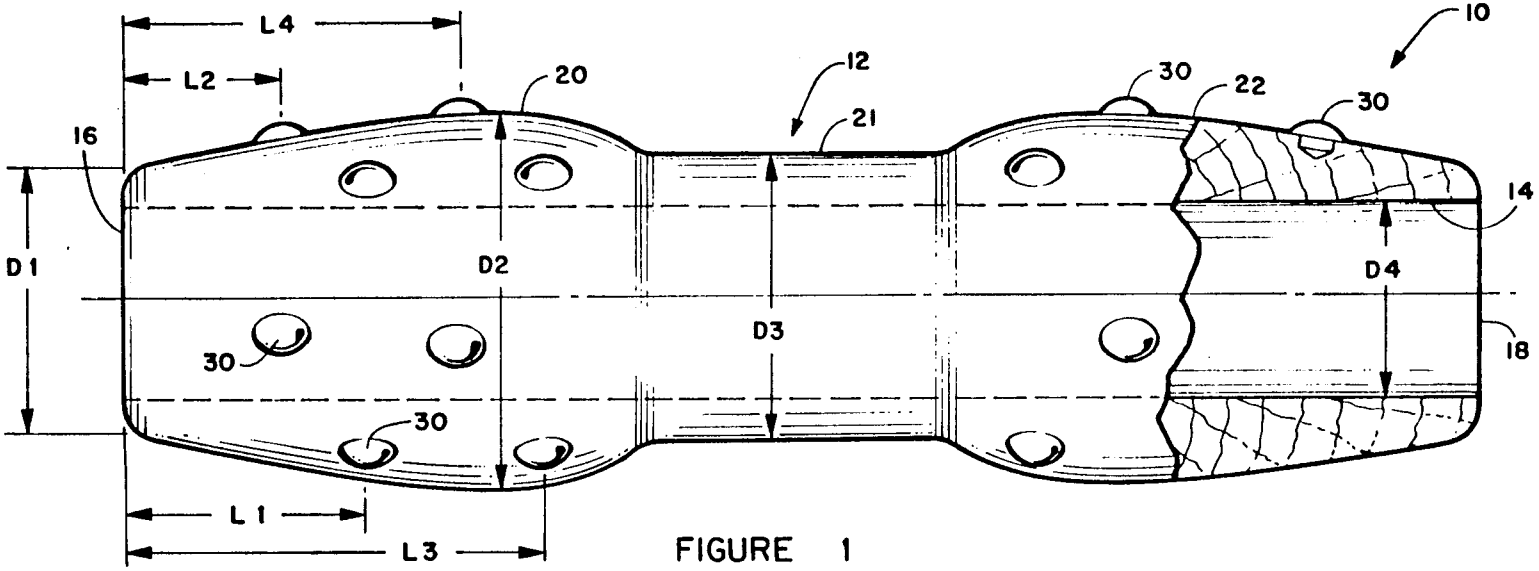
FIG. 1 is a top plan view of the novel foot massage device with portions broken away for clarity.

Applicant's novel foot massage device will now be described by referring to FIGS. 1-3 of the drawing. The foot massage device is generally designated numeral 10.

Foot massage device 10 has a tubular body 12 having a bore 14 that passes from its left end 16 to its right end 18. Tubular body 12 has a left end portion 20, a central portion 21 and a right end portion 22. The left end portion and the right end portion each have a convex outer surface along their longitudinal dimensions. The outer ends of the respective left end portion and right end portion have a outer diameter DI=2 3/16. The diameter of these portions at their maximum width is D2. D3 is the diameter of the central portion and it is substantially constant at 2½ throughout its length. D4 is the diameter of the bore 14 and it is 1¾".

A predetermined number of protruberances are formed along the outer surface of the left end portion 20 and the right end portion 22. These protrubances 30 are oriented in a predetermined pattern of annular rows that are spaced inwardly from the respective ends of the tubular body at the respective axial distances L1=1⅜", L2=2", L3=2 11/16", and L4=3½". The protruberances are approximately ⅜" in diameter. They have a height of approximately of 5/32". The protruberances of the respective rows are staggered so that they are not longitudinally aligned. In the preferred embodiment, there are seven protruberances per each row. Also the length of the tubular body is approximately 11".

Figure 2:
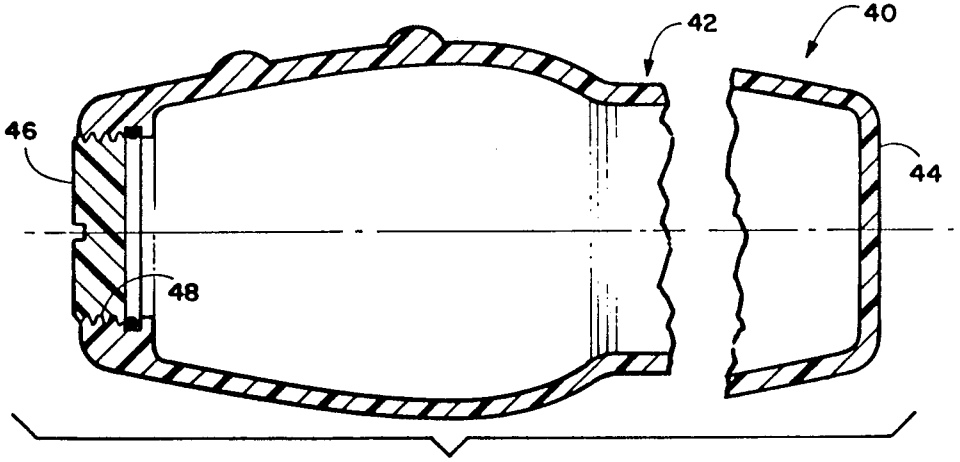
FIG. 2 is a top plan view of a first alternative embodiment of the novel foot massage device with portions broken away for clarity.

An alternative embodiment of the novel foot massage device is illustrated in FIG. 2. The foot massage device 40 has a tubular body 12 having a left end portion, a central portion, and a right end portion. The right end portion is closed by end wall 44. The left end portion is closed by a plug 46 that is threadably engaged in threaded bore 48. When the plug is inserted therein, a closed chamber for a heated or cooled fluid is thus provided.

Figure 3:
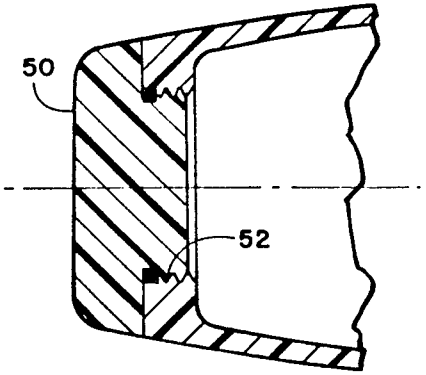
FIG. 3 is an alternative end closure structure for the embodiment illustrated in FIG. 2.

In FIG. 3 an alternative end for the embodiment illustrated in FIG. 2 is shown. A cap 50 closes the left end portion and it has external threads that are engaged by the threaded bore 52 of the tubular body 42.

What is claimed is:

1. A foot massage device comprising:

an elongated tubular body having a left end, a right end, and a longitudinally extending axis, said tubular body being substantially 11 inches long;

said tubular body having a predetermined length that is sequentially formed by a left end portion, a central portion, and a right end portion;

said left end portion having a left end whose outer diameter is substantially equal to 2 3/16 inches and a right end whose outer diameter is substantially equal to 2 ½ inches, said left end portion having a continuous convex curvature that extends from its left end to its right end with its greatest diameter D3 being closer to its right end than to its left end and D2 being greater than either D1 or D3;

said central portion having a substantially constant outer diameter D2 along its entire length, the length of said central portion being shorter than either said left end portion or said right end portion;

said right end portion having a right end whose outer diameter is substantially equal to 2 3/16 inches and a left end whose outer diameter is substantially equal to 2½ inches, said right end portion having a continuous convex curvature that extends from its right end to its left end with its greatest diameter D3 being closer to its left end than to its right end and D2 being greater than D1 or D3;

a predetermined number of protruberances formed along the outer surface of said left end portion and said right end portion, said protruberances having a substantially hemispherical shape each having a diameter substantially equal to ⅜ of an inch; and said protruberances being oriented in a predetermined pattern of four annular rows that are spaced inwardly from the respective ends of the tubular body at the respective axial distances L1, L2, L3 and L4, the protruberances of said respective rows being staggered so that none of them are longitudinally aligned and L1=2", L2=1⅜", L3=3½" and L4=11/16".

2. A foot massage device as recited in claim 1 wherein said tubular body has a substantially constant internal diameter D4 throughout its entire length.

3. A foot massage device as recited in claim 1 wherein the right end of said tubular body has a fixed end wall that closes that end.

4. A foot massage device as recited in claim 3 wherein said left end of said tubular body has a removable end wall in the form of a plug.

5. A foot massage device as recited in claim 3 wherein said left end of said tubular body has a removable end wall in the form of screw-off cap.

* * * * *